United States Patent [19]

Dreher et al.

[11] Patent Number: 4,695,001

[45] Date of Patent: Sep. 22, 1987

[54] MEANS FOR CUTTING TO LENGTH AND WINDING WINDING MATERIAL

[75] Inventors: Anton Dreher; Josef Gramer, both of Horb, Fed. Rep. of Germany

[73] Assignee: Hans Deissenberger, Horb am Neckar, Fed. Rep. of Germany

[21] Appl. No.: 780,444

[22] Filed: Sep. 26, 1985

[30] Foreign Application Priority Data

Oct. 18, 1984 [DE] Fed. Rep. of Germany ..... 3438212

[51] Int. Cl.[4] ..... B65H 54/02

[52] U.S. Cl. ..... 242/25 R; 242/47; 242/48

[58] Field of Search ..... 242/25 R, 18 R, 19, 242/1, 47, 53, 48, 50

[56] References Cited

U.S. PATENT DOCUMENTS 529,285 11/1894 Mathers ..... 242/48
3,042,329 7/1962 Signorella ..... 242/48
4,052,019 10/1977 Dickson, Jr. ..... 242/47
4,239,187 12/1980 Boggs et al. ..... 242/47 X
4,253,289 3/1981 Cole et al. ..... 242/48 X
4,557,423 12/1985 Zingler ..... 242/47 X

*Primary Examiner*—Stanley N. Gilreath
*Attorney, Agent, or Firm*—Bachman & LaPointe

[57] ABSTRACT

A means for cutting to length and winding winding material is proposed, in which a threading-through device is positioned downstream of the cutting to length device and enables the start of the winding material to be automatically threaded into a winding head. The speed of the winding head is so set by means of the control, that cutting to length and winding of the winding material can be performed in one process. The control also operates a centering device, a lateral displacement device and a tying device. This means makes it possible for winding material taken from a delivery spool to be cut to length, wound and tied in an automatically performed process.

7 Claims, 6 Drawing Figures

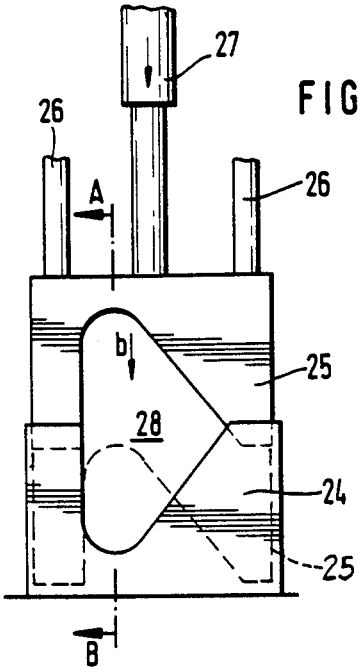
FIG. 2
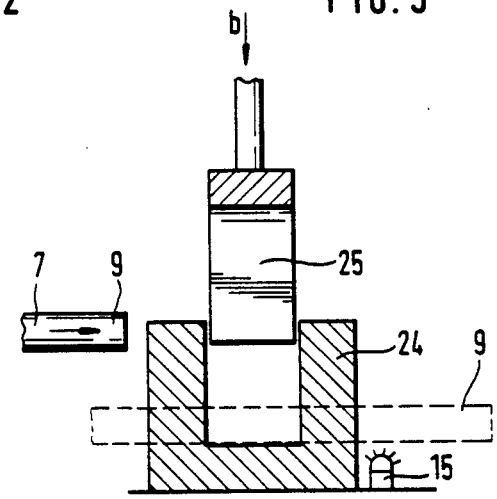
FIG. 3
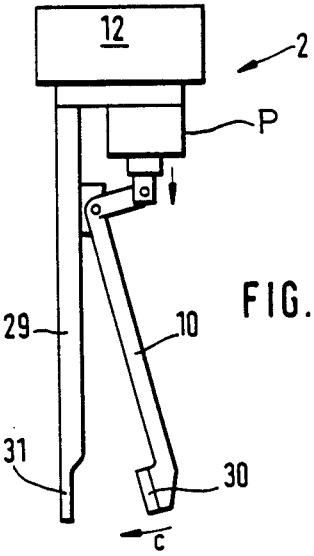
FIG. 4
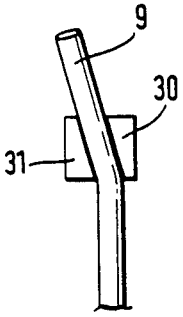
FIG. 5
FIG. 6
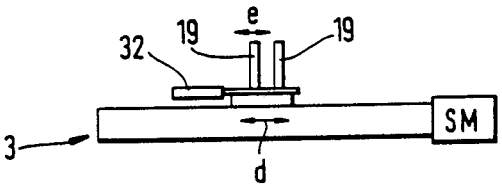

MEANS FOR CUTTING TO LENGTH AND WINDING WINDING MATERIAL

BACKGROUND OF THE INVENTION

The present invention relates to a means for cutting to length and winding winding material which comprises a cutting to length device for measuring and cutting to length the winding material. In the hitherto known means, the winding material was initially cut to a predetermined length and then wound up by means of a winding head in a completely separate process, after which it was tied and optionally packed. Hitherto there has been no apparatus or means for a continuous, automatic working process for cutting to length and winding the cut winding material.

The problem of the invention is to provide a means of the aforementioned type, enabling the cutting to length and winding of the cut winding material to be performed in an automatic process.

SUMMARY OF THE INVENTION

The problem is solved by providing a threading-through device in the working direction downstream of the cutting to length device, and a winding device downstream of the threading-through device, the threading device having a linearly displaceable gripper arm which conveys the start of the winding material to the winding device positioned in spaced manner and introduces same into a clamping device of the winding head of the winding device. The means essentially comprises a per se known cutting to length device, which is followed by a threading-through device and a winding device. The cutting device draws the winding material to be cut, e.g. from a large delivery spool and conveys the same to the threading device. The latter grips by means of a gripper arm the start of the winding material and conveys it to the winding device, where the start of the winding material is inserted in a clamping device. The winding head can then start to wind, the winding speed or the speed of the winding head having to be adapted to the working speed of the cutting device. The gripper arm is obviously open during the winding process and waits in its initial position for the next start of the winding material.

This means e.g. makes it possible to cut from a large delivery spool and automatically wind a predetermined number of cable pieces of the same length.

In order to bring about an exact centering of the start of the winding material in the vicinity of the gripper arm, a centering device is preferably arranged between the cutting to length device and the threading-through device. This centering device has a centering opening, whose opening width is reduced after passing through the start of the winding material, so that the latter is given a clearly defined position (centering). The centering device preferably comprises a centering cavity and a centering punch or plunger movable from above against said cavity. Through the lowering of the centering plunger, the adjustable opening bounded by the centering cavity and centering plunger is made smaller. As a result of this centering the gripper takes up the winding material in a clearly defined position, which ensures a precise feeding of the start of the winding material to the winding head.

In order to permit a uniform winding of the winding material, a lateral displacement device is positioned upstream of the winding head in the working direction and it so laterally displaces the winding material during the winding process and as a function of the winding speed, that the turns are closely juxtaposed on the winding head.

The winding speed can be easily adapted to the working speed of the cutting to length device, in that between the latter and the winding head are spacedly arranged to proximity switches, which are operated by the winding material as a function of the degree of sag, the proximity switches being connected to a central control for controlling the winding speed. The two proximity switches are consequently positioned below the direct connection between the cutting device and the winding head, so that in the case of a limited sag of the winding material the upper proximity switch is operated first and in the case of greater sag this applies to the lower proximity switch. The winding head speed is set to a minimum by the control at the start of the winding process until the lower proximity switch indicates a corresponding pronounced sag of the winding material and leads to the increase in the winding speed. This higher speed is maintained until the upper proximity switch is operated by the winding material and as a result the winding speed is reduced again. Thus, in this way, the winding speed can be controlled with simple means, so that the winding material always sags somewhat between the cutting device and the winding head within predetermined limits given by the two proximity switches and as a result the winding device is not influenced by this.

The winding head and also the linear drive of the gripper of the threading device are preferably driven by stepping motors, which can be so operated via the control that the gripper and winding head can be exactly brought into specific positions.

Advantageous further developments of the invention are characterized in the subclaims.

BRIEF DESCRIPTION OF THE DRAWINGS

The invention is described in greater detail hereinafter relative to non-limitative embodiments and the attached drawings, wherein show:

FIG. 2 A centering device used in the means according to FIG. 1.

FIG. 3 A side view of the centering device shown in FIG. 2 in section (AB).

FIG. 4 The gripper arm of a threading-through device, as used in the means according to FIG. 1.

FIG. 5 The jaws of the gripper arm of FIG. 4 in section.

FIG. 6 A lateral displacement device.

DETAILED DESCRIPTION OF THE PREFERRED EMBODIMENTS

Figure 1:
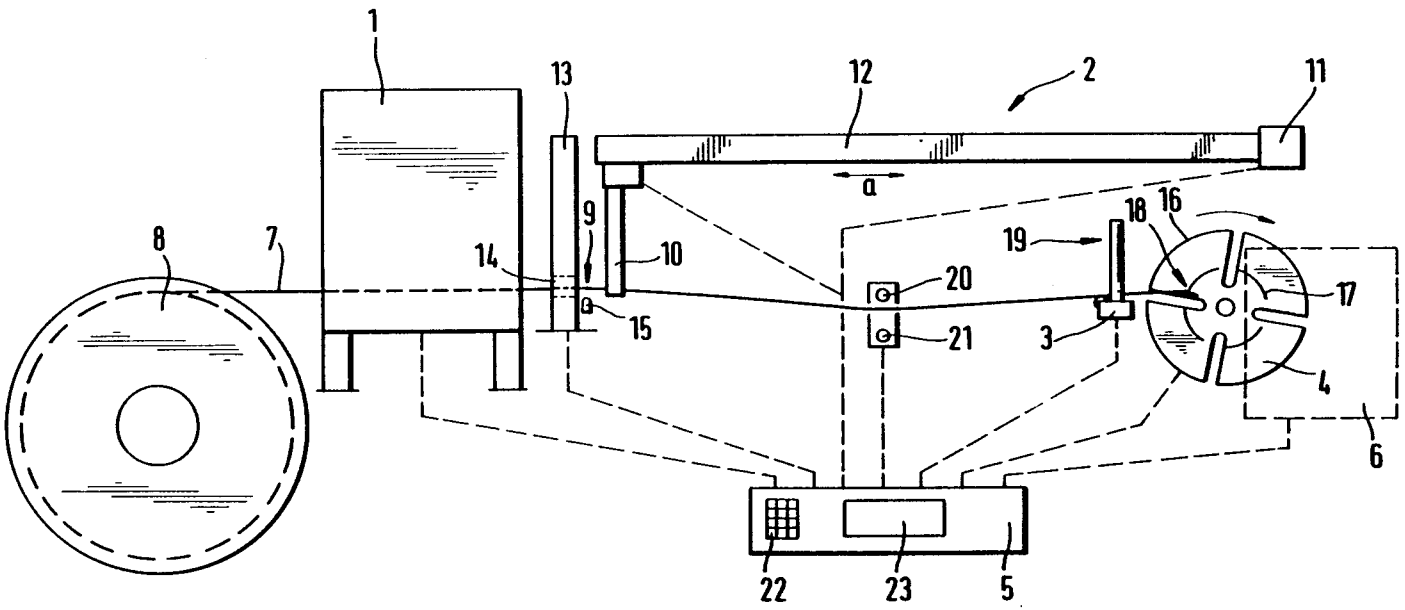
FIG. 1 A diagrammatic view of the means according to the invention.

The means shown in FIG. 1 for cutting to length and winding the cut winding material essentially comprises a cutting to length device 1, a threading-through device 2, a lateral displacement device 3, a winding device 4 and a central control 5. With winding device 4 is also associated an automatic tying device 6, which enables the tying of the wound winding material. The cutting device 1 takes the winding material 7 to be cut to length from a delivery or storage spool or drum 8 and leads the start 9 of the winding material to a gripper 10, which is linearly displaceable in accordance with arrow directions a. A linear unit 12 driven by a stepping motor 11 permits a precise lateral displacement of gripper 10 in accordance with arrow direction a. Gripper 10, stepping motor 11 and linear unit 12 form the threading device 2.

Between the threading device 2 and/or between the gripper 10 and cutting device 1 is provided a centering device 13, the start 9 of the winding material being passed through the centering opening 14 thereof by the cutting device 1. A light barrier 15 indicates the presence of the start 9 of the winding material to the central control 5, which then leads to the centering opening 14 undergoing a size reduction and gripper 10 gripping the start 9 of the winding material and conveying it to the winding device 4.

All that is shown of the winding device 4 in the drawing is the winding head 16, which is shown in simplified form. Its winding core 17 has at least one recess 18, into which the start 9 of the winding material can be introduced by gripper 10. In the vicinity of recess 18, the winding head has not shown clamping elements, which fix the start 9 of the winding material at this point.

Upstream of winding head 16 is positioned the lateral displacement device 3, which preferably comprises two vertically spaced rollers, which are jointly displaceable parallel to the rotation axis of winding head 6. Winding material 7 is moved between the two vertical rollers 19 (FIG. 6). The spacing of the two rollers 19 can be varied by means of a pneumatically operated cylinder, so that the gripper 10 can be passed in an unimpeded manner between the two rollers 19 and an adaptation to the different winding material diameter is possible.

Roughly in the center between cutting device 1 and winding head 16 are provided two spaced proximity switches 20, 21. These can be capacitive, inductive or electrooptical proximity switches. Both the proximity switches 20, 21 are connected to the central control 5 and indicate that the winding material 7 passed by them is approaching the central control 5. If the winding material 7 sags slightly, so that the upper proximity switch 20 is operated, the control 5 sets the speed of winding head 16 to a minimum value. The latter is fixed in such a way that the winding speed is lower than the conveying speed of the cutting device 1. Thus, winding material 7 will sag to an ever greater extent until the lower proximity switch 21 indicates such a pronounced sag of winding material 7 to control 5. As a result control 5 sets the speed of winding head 6 to an upper value until once again the upper proximity switch 20 is operated. This leads in simple manner to an adaptation of the winding speed to the working speed of cutting device 1.

The central control 5 is connected to all the controllable devices in the means by control lines represented here in broken line form. Control 5 preferably has a keyboard 22 and a digital display 23. By means of the keyboard 22, it is e.g. possible to enter the number of cable pieces to be cut to length, the length thereof and also the upper or lower winding speeds. The winding material diameter can also be entered, so that the lateral displacement device 3 can be correspondingly laterally displaced per revolution of winding head 6. At the end of the winding process, control device 5 can also position winding head 16 in such a way that the tying device 6 can automatically tie the wound winding material.

The centering device shown in FIG. 2 comprises a fixed centering cavity 24 and a centering punch or plunger 25 movable in accordance with arrow direction b. Centering plunger 25 is guided by means of two guide rods 26 and is operated by an e.g. pneumatically operable cylinder 27. The centering opening 28 surrounded by the centering cavity 24 and centering plunger 25 undergoes a size reduction through the lowering of centering plunger 25, until the winding material 7 passed through it is centered.

The winding material 7 is passed through centering opening 28 in accordance with arrow direction of FIG. 3 and as a result of the large opening width of central opening 28 relatively large tolerances with respect to the position of winding material 7 are possible. Only after the start 9 of winding material 7 has been passed through the centering opening 28 is the centering plunger lowered in accordance with arrow direction b, so that said start 9 is brought into a clearly defined position indicated by broken lines in FIG. 3.

FIG. 4 shows the threading-through device in simplified cross-sectional form. The gripper arm 10 can be pivoted against a rigid stop 29 in accordance with arrow direction c. Gripper arm 10 and stop 29 have in each case at their lower end a jaw 30, 31, whose facing clamping faces slope with respect to the conveying direction of threading device 2. Jaws 30, 31 are constructed in such a way that the fixed start 9 of the winding material is bent in the manner shown in FIG. 5. This bending has the advantage that the start 9 of the winding material can be introduced without difficulty into recess 18 on winding head 16, even if this is arranged at the edge of the winding core 17.

FIG. 6 shows the basic construction of the lateral displacement device 3, whose two vertically positioned rollers 19 are jointly displaceable in accordance with arrow direction d. The left-hand roller 19 is displaceable with respect to the right-hand roller 19 in accordance with arrow direction e, so that adaptation to different winding material diameters and opening for passing through gripper 10 are possible. In order to operate the left-hand roller 19 a cylinder 32 is provided. The lateral displacement device 3 is driven in the same way as winding head 16 and threading device 2 by a stepping motor SM, which by means of control 5 permits an accurate positioning.

OPERATION

The cutting and measuring device 1 advances the lead end 9 of strand material 7 from the supply drum 8 through the enlarged opening 28 in centering device 13.

When the light barrier 15 "reads" the presence of the lead end 9 of the strand 7, a signal is sent to the centering device 13 via central control 5 activating the centering device 13. That is, a signal is sent to the pneumatic cylinder 27 (FIG. 2) causing the piston thereof to move plunger 25 downwardly in the direction of arrow b to reduce the size of opening 28 (see dotted line position of plunger 25 in FIG. 2). This occurrence moves the lead end 9 of the strand 7 downwardly from the solid line position of FIG. 3 to the dotted line position thereof thereby centering the lead end 9 relative to the gripper 10 of the threading device 2.

At the same time a signal is sent by the light barrier 15 to gripper 10 energizing jaw piston P causing jaws 30-31 to grasp the lead end 9. Simultaneously a signal is sent to stepping motor 11 causing the threading device 2 to begin the advance of the lead end 9 toward the take-up reel or winding device 4 leading the end 9 through rollers 19—19.

Note that the jaws 30 and 31 of stop arm 29 and gripper arm 10 have mutually bevelled faces operable to cast the lead end 9 askew thereby facilitating introduction of the lead end 9 into the recess or slot 18 of the take up or winding head 4.

What is claimed is:

1. In a winding and reeling apparatus for strand material including a measuring and cutting unit for feeding said strand material, the improvement comprising:

a strand supply reel and a take-up reel;

a threading device for grasping and for advancing a lead end of said strand material toward said take-up reel;

centering means between said cutting and measuring unit and said threading device operable to position said lead end for connection with the threading device, and;

sensing means adjacent said centering means for indicating the presence in said centering means of said lead end, said threading device being operable in response to said sensing means to grasp and to advance said lead end toward said supply reel.

2. The apparatus of claim 1 including a linear unit and power means for reciprocating said threading device along a path generally parallel to the line of advance of said strand material.

3. The apparatus of claim 1 in which the centering means includes a pair of relatively moveable members and power means for actuating said members, said power means being operable in response to said sensing means.

4. The apparatus of claim 3 in which the relatively moveable members are moveable from a first position defining a wide tolerance opening for the receipt of strands of varying sizes to a small opening for positioning a sensed strand for connection with said threading device.

5. The apparatus of claim 1 in which the threading device includes a pair of relatively moveable arms terminating in jaws and power means responsive to said sensing means for actuating said arms whereby said jaws grasp said lead end.

6. The apparatus of claim 5 in which the jaws are formed with cooperating bevelled faces operable to grasp said lead end and cant said end at an acute angle relative to the line of advance of said strand material to facilitate introduction of said end into the take-up reel.

7. The apparatus of claim 1 including means for controlling sag of the strand material as it advances from the supply reel to the take-up reel.

* * * * *